United States Patent [19]

Landa

[11] Patent Number: 4,586,810

[45] Date of Patent: May 6, 1986

[54] ENGINEERING DRAWING ELECTROPHOTOCOPIER

[75] Inventor: Benzion Landa, Edmonton, Canada

[73] Assignee: Savin Corporation, Stamford, Conn.

[21] Appl. No.: 204,775

[22] Filed: Nov. 7, 1980

[51] Int. Cl.[4] ..... G03G 15/04

[52] U.S. Cl. ..... 355/12; 355/3 R; 355/106; 355/117

[58] Field of Search ..... 355/3 R, 12, 104, 106, 355/113, 117, 119

[56] References Cited

U.S. PATENT DOCUMENTS

| | | | |
|---|---|---|---|
| 2,689,179 | 9/1954 | Walkup et al. | 355/12 |
| 2,917,986 | 12/1959 | Williamson | 355/104 |
| 3,288,605 | 11/1966 | Macklem | 355/12 X |
| 3,308,233 | 3/1967 | Button et al. | 346/160 X |
| 3,308,731 | 3/1967 | Olden | 355/12 X |
| 3,549,251 | 12/1970 | Olden | 355/12 X |
| 3,676,001 | 7/1972 | Botkin | 355/12 X |
| 3,748,034 | 7/1973 | Luebbe | 355/3 R |

FOREIGN PATENT DOCUMENTS

| | | | |
|---|---|---|---|
| 718558 | 9/1965 | Canada | 355/12 |

*Primary Examiner*—Fred L. Braun
*Attorney, Agent, or Firm*—Shenier & O'Connor

[57] ABSTRACT

An electrophotocopier for relatively large and valuable originals such as engineering drawings, wherein an electrostatic image is formed by contact exposure using a fluorescent light source and wherein contamination of the original by solid or liquid components of the developer is prevented by a transparent membrane disposed between the photoconductive imaging surface and the original.

12 Claims, 18 Drawing Figures

53
14c
53c
30a
86a
51
87
11
31b
31a
86
10
10
80c
81d
81
81a
80b
80d
86b
48a
48b
64c
64b
83b
73
83a
73a
10B
84a
85b
84
84b
68
62a
68a
85a
83c
10B
68d
82
81b
81
83
81c
83d
73a
73
83a
83b
84a
68a
85d
85b
84b
68
84
85a
83c
85c
62a
68d
81b
81

TO FIG.7A →

TO FIG.7 ← FIG.7A → TO FIG.7B
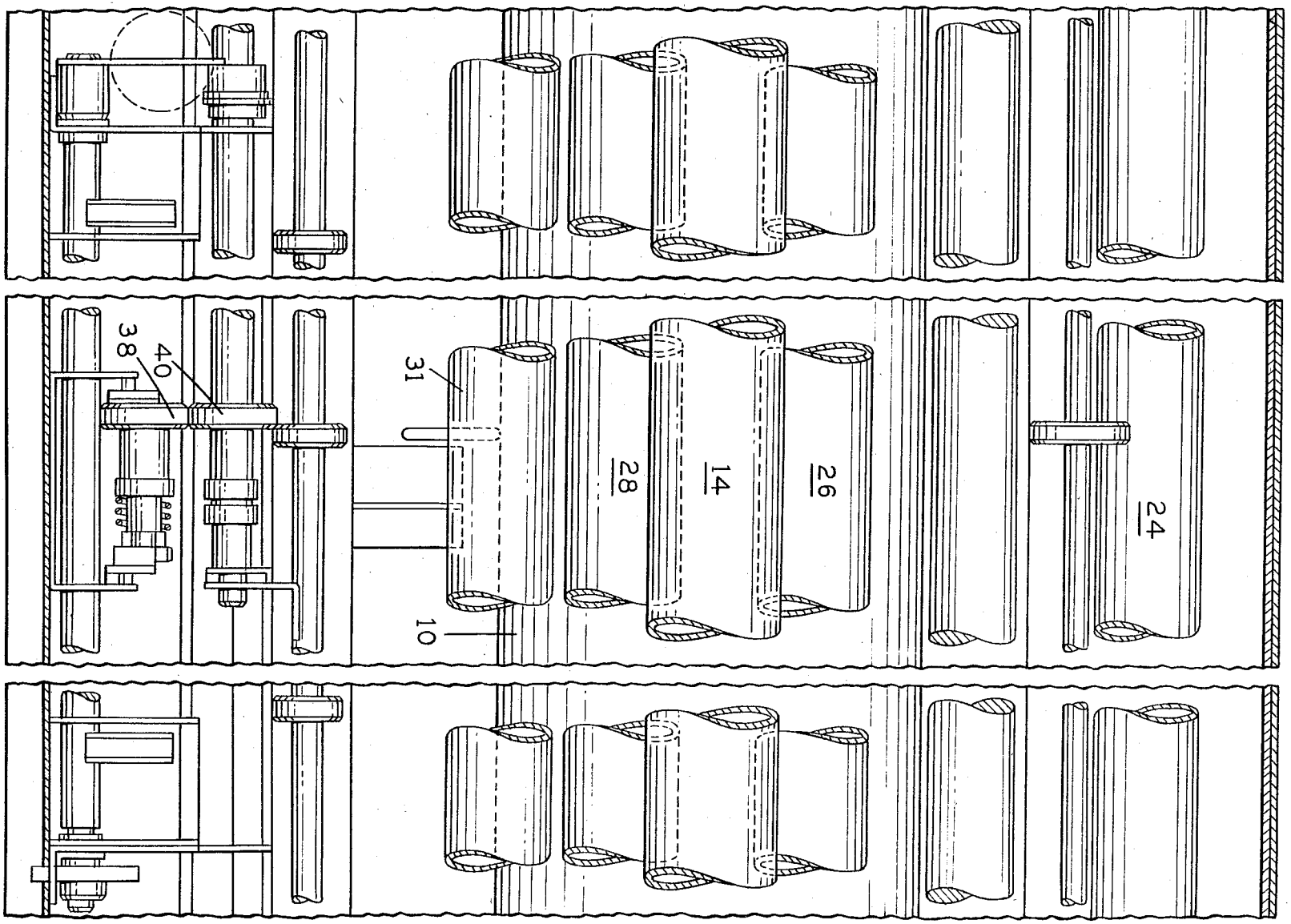

ENGINEERING DRAWING ELECTROPHOTOCOPIER

BACKGROUND OF THE INVENTION

Engineering drawings are relatively large documents which may have widths of as much as 84 centimeters, or 33 inches and lengths as much as 119 centimeters or 47 inches. In prior art electrophotocopying machines, an image of the original is focused by a lens, usually of the reflex type, upon a photoconductive drum. In order to expose a relatively large document such as an engineering drawing within a reasonable time such as approximately seven seconds, it is found that the power input to a tungsten halogen illumination lamp is approximately $46f^2$ watts, depending upon the f number of the lens assuming a magnification of unity. A standard 110 volt outlet has a maximum current rating of 15 amperes which provides a power output of 1650 watts. The smallest lens which can be used would be f-6. Such lens would have a diameter of approximately 19 centimeters or 7.5 inches and weigh approximately 11 kilograms or 24 pounds. It is clear that the cost of such large lenses would be inordinately high.

In making copies of engineering drawings, diazo machines are usually employed using coated papers, where the exposure is by contact rather than by the focusing of an optical image. While contact exposure has a relatively high efficiency, it has not been considered suitable for electrophotographic copiers, since contact between the original document and the photoconductive drum would result in the deposition of some toner upon the original document and would also moisten the original document where liquid developers are used. Since engineering drawings may be large documents upon which many man hours have been spent, it is absolutely essential that they not be damaged by the electrophotocopier. For unity magnification contact exposure, the power required by a fluorescent lamp to expose a relatively large engineering drawing in seven seconds is approximately 0.18/D watts, depending upon the transmittance D of the original. Even if the transmittance of the original is as low as 0.24%, the fluorescent lamp power required is only 75 watts. Since very high output fluorescent lamps can operate at 0.9 watt per centimeter, an 84 centimeter fluorescent lamp can be used.

SUMMARY OF THE INVENTION

In general my invention contemplates an electrophotocopier for relatively large and valuable originals such as engineering drawings, wherein contact exposure is used to obviate the extremely high lamp power and relatively large lenses required in optical projection. For contact exposure the lamp power is orders of magnitude less; and is readily accommodated by a fluorescent lamp. Contamination of the valuable original by solid or liquid components of developer remaining upon the photoconductive drum is obviated by providing a thin flexible transparent shield film or membrane between the photoconductive drum and the original. This shield film or membrane provides a minimal separation between the photoconductive drum and the original, and produces no detectible degradation in resolution of the substantially contact image formed on the photoconductive surface.

One object of my invention is to provide an electrophotocopier which can reproduce relatively large originals such as engineering drawings.

Another object of my invention is to provide an electrophotocopier employing contact exposure.

Still another object of my invention is to provide an electrophotocopier employing contact exposure and having a shield membrane or film disposed between the original and the photoconductive surface.

Other and further objects of my invention will appear from the following description.

BRIEF DESCRIPTION OF THE DRAWINGS

In the accompanying drawings which form part of the instant specification and which are to be read in conjunction therewith and which like reference numerals are used to indicate like parts in the various views.

FIGS. 7, 7A and 7B comprise a front sectional view.

DESCRIPTION OF THE PREFERRED EMBODIMENT

Figure 1:
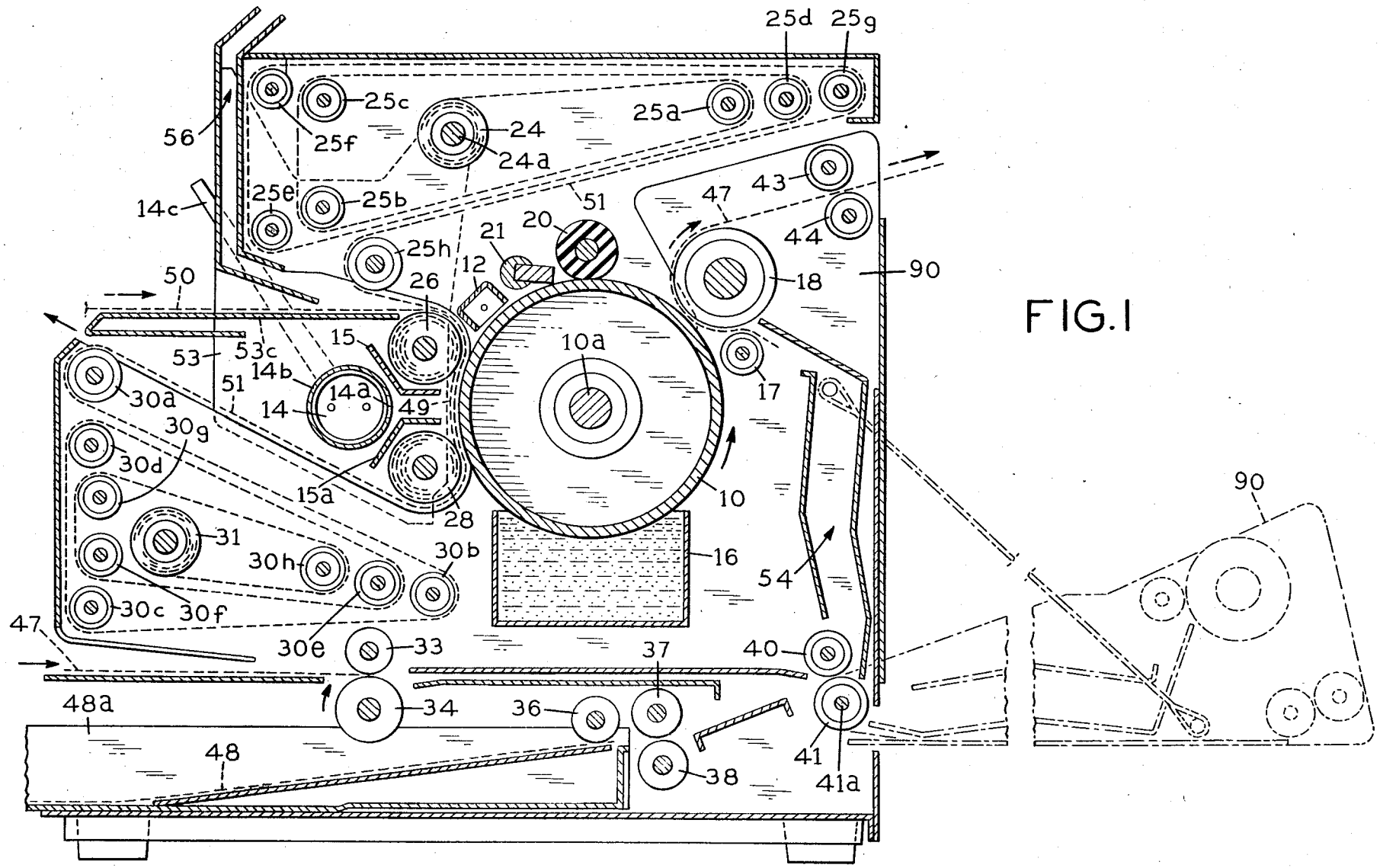
FIG. 1 is a side sectional view of my electrophotocopier.

Referring now to FIG. 1 of the drawings, a drum 10 having a photoconductive surface is rotatably mounted on a shaft 10*a*. As is usual in electrophotocopiers, the photoconductive surface of drum 10 is charged by a corona 12, then exposed to light from lamp 14, and then developed, as by a liquid developer in tank 16. The developed image on the photoconductive surface of drum 10 is then transferred to paper passing under roller 18. Residual toner not transferred from the surface of the drum is removed by cleaning roller 20 and scraping blade 21.

The shield membrane 51 may be formed of a polyester film, such as Mylar, a registered trademark of E. I. duPont deNemours and Company. The shield film 51 is transparent and may have a thickness of the order of magnitude of 2 to 4 mils. It may be noted that the drawing paper itself may have a thickness of about 4 mils. Assuming that the largest original to be copied is a drawing paper of size DIN A-0 which has dimensions of 84 cm by 119 cm, the drum 10 may have a length of 84 cm; and shield film 51 should have a width appreciably greater than this as, for example, 86 cm. Shield film 51 is wound about a supply spool 24 and passes successively over rollers 25*a*, 25*b*, 25*c*, 25*d*, 25*e*, 25*f*, and 25*g* in a path which may generally be described as an expanding spiral. Membrane 51 then passes over roller 25*h*.

A member 53 is rotatably mounted upon the same shaft 24*a* which mounts spool 24. Member 53 mounts two further spools 26 and 28 about which are wound a transparent pressure plate film or membrane 49 which may also be formed of a polyester film such as Mylar, having a thickness of the order of magnitude of 2 to 8 mils. The original 50 to be copied is placed on shelf 53*c* and moved forwardly until its leading edge is sandwiched between the shield film 51 and the pressure plate film 49. The exposure station is defined by fixed aperture plates 15 and 15*a* which extend generally between spools 26 and 28. A very high output fluorescent lamp 14 is disposed between aperture plates 15 and 15*a*. Lamp 14 is generally surrounded by a member 14*b* having an internally reflective coating. Member 14*b* is provided with an aperture 14*a* through which light from lamp 14 may pass between plates 15 and 15*a* through pressure plate film 49, the original 50, and shield film 51 to the photoconductive surface of drum 10. The exposure may be adjusted by moving handle 14*c* which is secured to lamp 14 thereby to rotate both the lamp and aperture 14*a*. In the position shown, aperture 14*a* is aligned with the aperture defined by plates 15 and 15*a*; and the exposure is maximum. Aperture plates 15 and 15*a* as well as lamp 14 are mounted on member 53.

The shield film 51, after passing over roller 25*h*, then passes over spool 26 and into contact with drum 10. Shield film 51 then passes over spool 28 and thence over a roller 30*a*. From roller 30*a*, the shield film 51 passes over rollers 30*b*, 30*c*, 30*d*, 30*e*, 30*f*, 30*g* and 30*h* to a take-up spool 31 in a path which may generally be described as a contracting spiral.

Copy paper 47 may be manually fed and passes between a pair of opposed rollers 33 and 34 to a further pair of opposed rollers 40 and 41. The rollers 33 and 34 are torque limited to permit sheet 47 to be manually withdrawn for accurate alignment. Copy paper 48 may be automatically fed from a magazine 48*a* by a roller 36 in conjunction with a pair of opposed rollers 37 and 38. As shown in my copending application Ser. No. 52,405 filed June 27, 1979, roller 38 is subjected to a reverse biasing torque to prevent simultaneous feeding of two sheets of copy paper 48. Copy paper 48 then passes to opposed rollers 40 and 41.

Assuming that the copy paper is the manually fed sheet 47 rather than the automatically fed sheet 48, the copy paper 47 passes between rollers 40 and 41 into a guide channel 54. Upon exiting from this guide channel, copy paper 47 passes between rollers 17 and 18 into contact with the developed image on the photoconductive surface of drum 10. The image transfered to copy paper 47 then passes between opposed rollers 43 and 44 and exits from the machine.

It will be understood that the surface of the shield film 51 adjacent drum 10 will be wetted or dampened with liquid toner from developer tank 16. It is essential that the other surface of film 51, the surface which bears against the original 50, be absolutely dry. It will further be appreciated that rollers 25*h* and 30*a* are wetted by contact with the wet surface of shield film 51. It is desired that rollers 25*a* through 25*g* and 30*b* through 30*h* remain completely dry and that no wetted film 51 be wound about either of the supply and take-up spools 24 and 31. If a film wetted on one surface is wound about either of spools 24 or 31, then both surfaces of film 51 would become wet. Accordingly, the length of film between spool 24 and roller 25*h* should be greater than 119 cm. Similarly, the length of film between roller 30*a* and spool 31 should also be greater than 119 cm. Rollers 25*a* through 25*g* and rollers 30*b* through 30*h* each provide generally spiraling path lengths well in excess of 119 cm, so that the exterior wet surface of the film 51 does not contact an interior dry surface of film 51. The total length of film 51 wound on spools 24 and 31 is well in excess of 360 cm. An equal length of film 49 is wound on spools 26 and 28.

Figure 2:
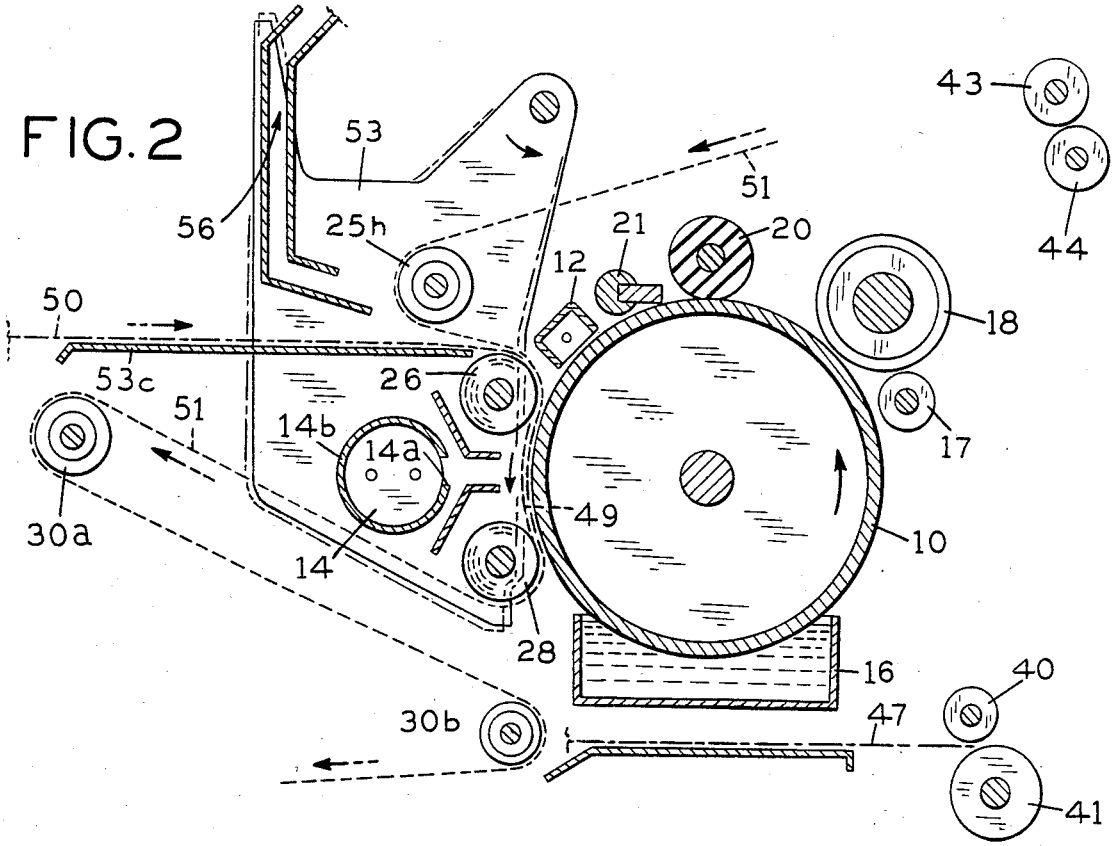
FIG. 2 is a fragmentary side sectional view showing the disposition of parts at the beginning of a cycle of operation.

In operation and referring to FIGS. 2 through 5, drum 10 continuously rotates counterclockwise. Member 53 which carries spools 26 and 28 is initially in the broken line position where, as may best be seen in FIGS. 4 and 5, the shield film 51 is well out of contact with the surface of drum 10. The original 50 to be copied is as shown in FIG. 2 moved forwardly along shelf 53*c* until its leading edge is sandwiched between pressure plate film 49 and shield film 51. The manually fed copy paper 47 is moved forwardly until entrained by rollers 33 and 34, which advance paper 47 until it is in the nip between rollers 40 and 41.

With the original 50 and the copy paper 47 in the positions shown in FIG. 2, and with member 53 in the dotted-line position of FIG. 2, a copying operation may be effected by depressing a start button, hereinafter described. Member 53 is resiliently biased counterclockwise in FIG. 2 but is held in the dotted line position (better shown in FIGS. 4 and 5) by a cam hereinafter described. When the start button is depressed, such cam is rotated to release member 53 from the dotted line position and permit it to rotate counterclockwise under its resilient bias to the solid-line position shown in FIG. 2 where film 51 contacts the surface of drum 10. At the same time, spools 24, 31, 26 and 28 are driven clockwise to advance both films with the same linear velocity as the surface of drum 10.

Figure 3:
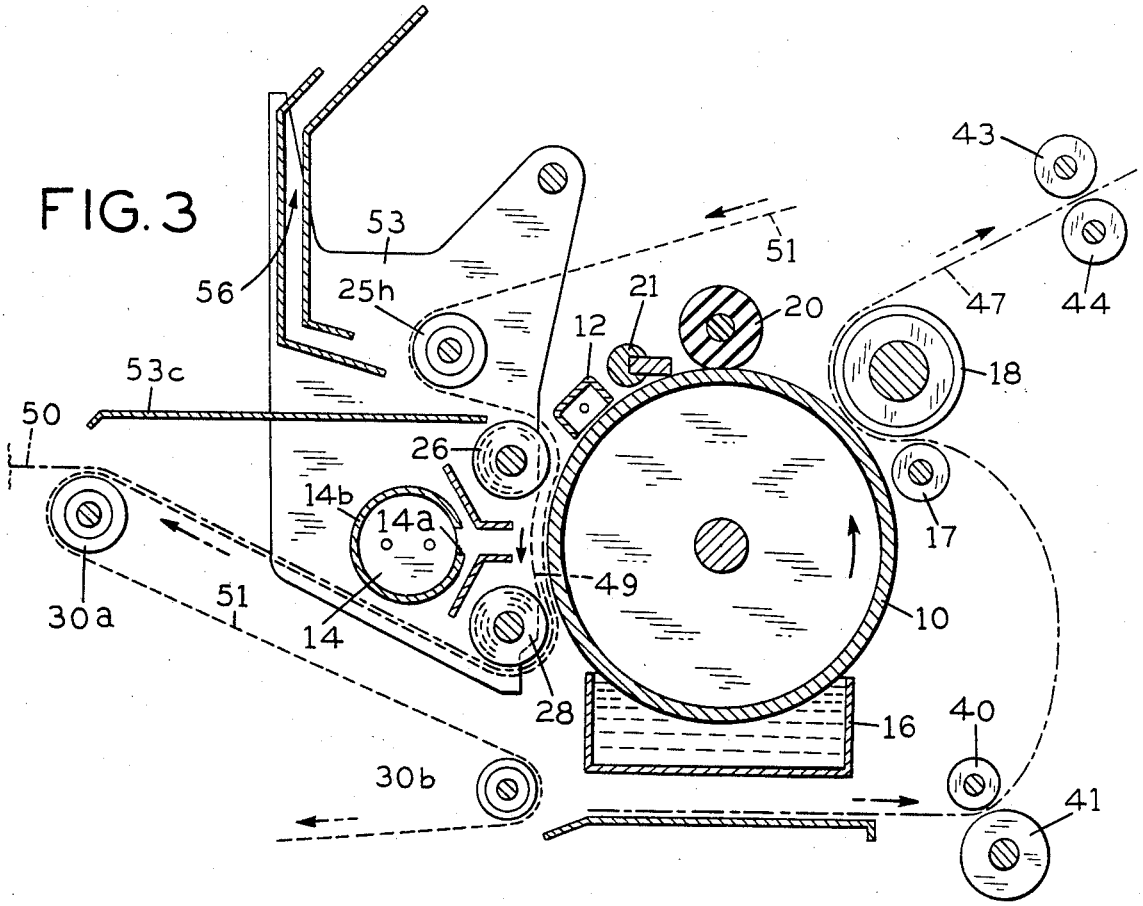
FIG. 3 is a fragmentary side sectional view showing the disposition of parts immediately after the original has been exposed.

Referring now to FIG. 3, after the films have advanced a distance somewhat greater than the length of the original 50, its trailing edge will pass the exposure station 15-15*a*; but the original will still be sandwiched between those portions of films 49 and 51 passing over spool 28. During the course of exposure of the original 50, the copy paper 47 is advanced through-channel 54 and between rollers 17 and 18 to transfer the developed image from the drum 10 to the copy paper 47.

Figure 4:
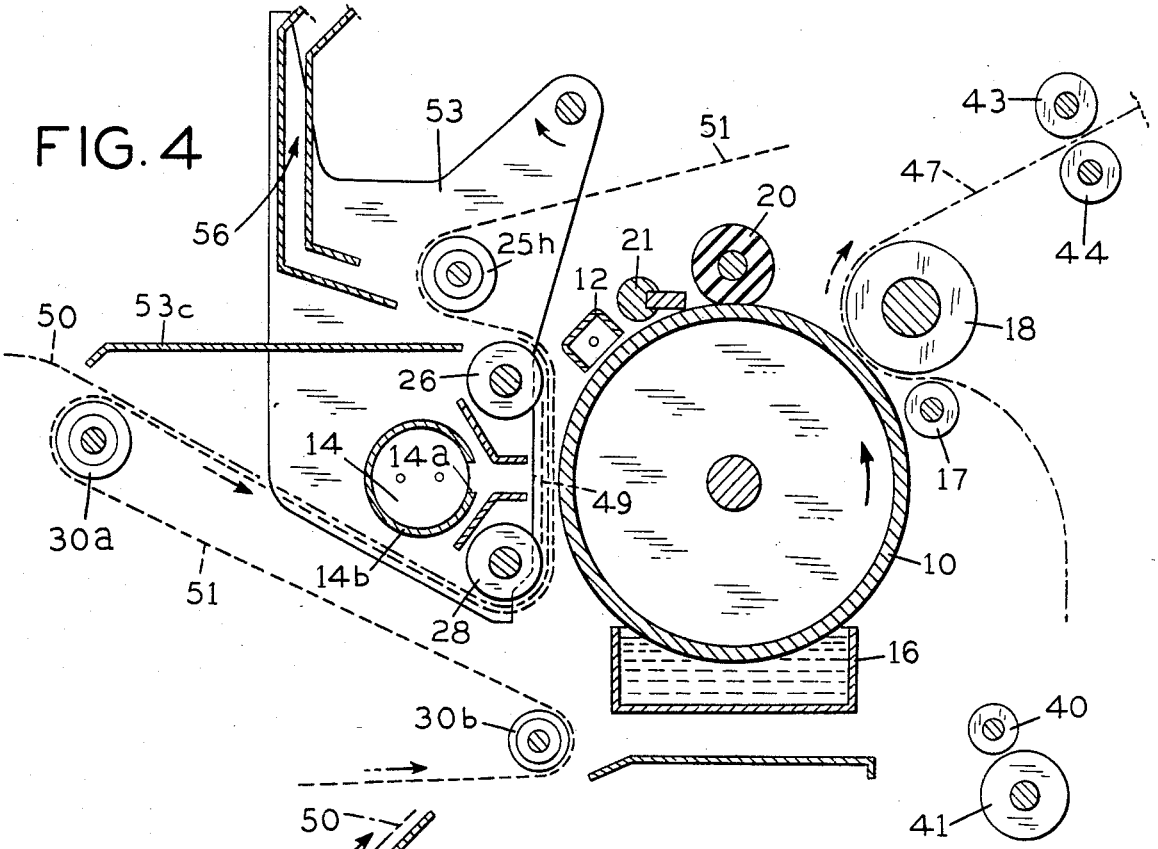
FIG. 4 is a fragmentary side sectional view showing the disposition of parts shortly after the original has been exposed.

Referring now to FIG. 4, member 53 is now rotated clockwise against its resilient bias by a cam so that film 51 is well out of engagement with drum 10. At the same time, spools 24, 31, 26 and 28 are reversed in direction to return the films 49 and 51 to their original positions.

Figure 5:
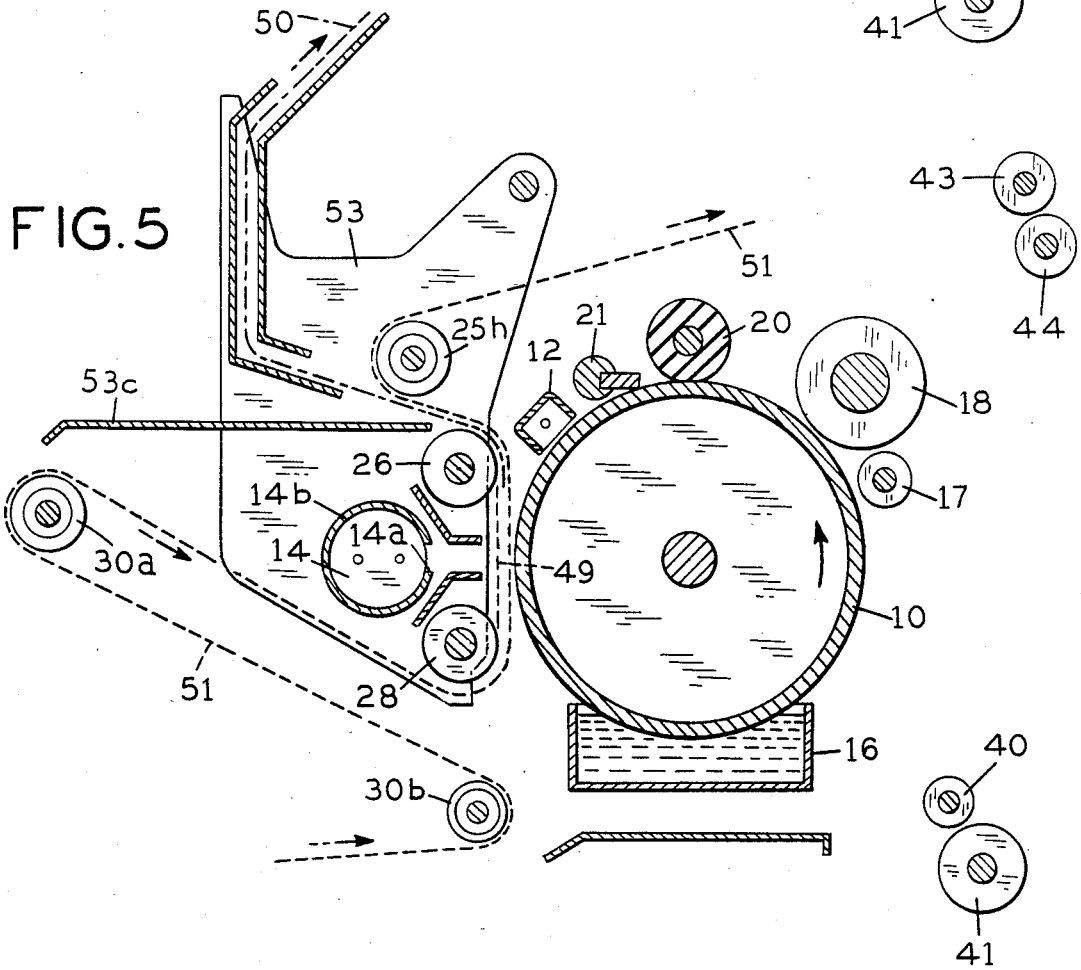
FIG. 5 is a fragmentary side sectional view showing the final disposition of parts upon completing a cycle of operation.

Referring now to FIG. 5, the original 50 is however not deposited on shelf 53*c* but, instead, passes upwardly through a channel 56 to the top of the machine. The leading edge of the original 50 is still entrained or sandwiched between those portions of films 49 and 51 passing over spool 26; and as many subsequent copies may be made as is desired. For second or subsequent copies the original 50 is fed downwardly through channel 56 rather than horizontally along shelf 53c.

Referring now to FIGS. 6, 7, 8 and 10 of the drawings, an electrical drive motor 59 is provided with a pinion sheave 60 which drives a toothed belt 61. Belt 61 engages a toothed sheave fixed to shaft 62a. As may best be seen from FIG. 10, a pinion 63 affixed to shaft 62a engages a gear 64b freely mounted for rotation upon a cam shaft 72. Gear 64b is connected by a sleeve 64 to a pinion 64a. Pinion 64a meshes with a gear 66 fixed on drum shaft 10a.

Also secured to shaft 62a is a member 63a in which is mounted one end of a helical clutch spring 69. Rotatably mounted on shaft 62a is an elongated sleeve 68 one end of which is surrounded by helical spring 69. The other end of spring 69 is mounted in a clutch control sleeve 70 which freely rotates on sleeve 68. Helical spring 69 is formed with a slightly larger diameter than that of sleeve 68 so that the spring clutch is normally disengaged. Secured to sleeve 68 are a cam 68a, a pinion 68b and a reverse drive sprocket 68c. Sprocket 68c engages a chain 87.

One end of a helical spring 75 is fixed in pinion 64a. Spring 75 surrounds one end of an elongated sleeve 74 freely mounted on cam shaft 72. The other end of spring 75 is mounted in a clutch control sleeve 76 freely rotatable upon sleeve 74. A clutch 85b may be moved either to engage sleeve 76 for forward drive or to engage sleeve 70 for reverse drive. Helical spring 75 is formed with a diameter slightly greater than that of sleeve 74 so that the forward drive clutch is also normally disengaged. Mounted on a sleeve 74 is a sprocket 74a, which also engages chain 87.

Gear 64b mounts a housing 64c. One end of a helical spring 64e is fixed in gear 64b. Mounted on cam shaft 72 within housing 64c is a clutch drum 72c. Helical spring 64e is formed with a diameter slightly less than that of drum 72c so that the spring clutch is normally engaged. A centering drum 72d is mounted on camshaft 72 between clutch drum 72c and gear 64b. Centering drum 72d has a reduced diameter which is appreciably less than that of drum 72c. Thus the portion of spring 64e wound about centering drum 72d acts as a resilient spring member while the portion of spring 64e which engages clutch drum 72c acts as a clutch. The other end of spring 64e is engaged by an internal tab 64d mounted within housing 64c. Mounted on cam shaft 72 are a pair of spaced cams 72a and 72b which engage respective followers 53a and 53b mounted on member 53, as may best be seen in FIG. 8.

Also fixed to camshaft 72 is a collar 73 provided with a tooth 73a. Rotation of camshaft 72 is controlled by an escapement member 83 rotatably mounted upon a shaft 82. As may best be seen from FIG. 9, member 83 is provided with a pair of spaced lugs 83a and 83b which engage tooth 73a. Tooth 73a engages a lug 84a formed integrally with a clutch control member 84 pivotally mounted upon shaft 82. Escapement member 83 and clutch control member 84 are biased counterclockwise in FIG. 9 by respective springs 83c and 84b. Escapement member 83 is connected by a link 83d to a solenoid 83e.

Figure 10B:
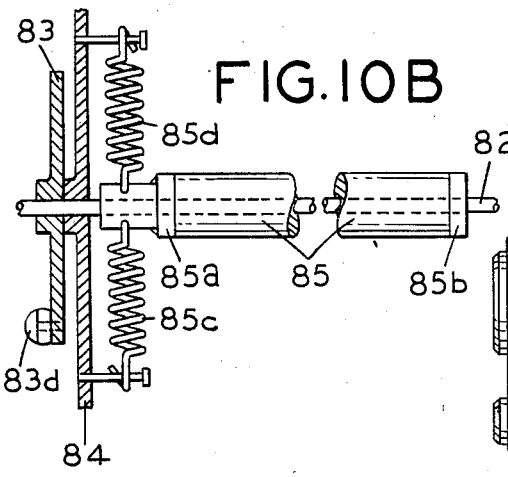
FIG. 10B is a sectional view of the clutch control elements taken along the line 10B—10B of FIG. 9.
Figure 10B:
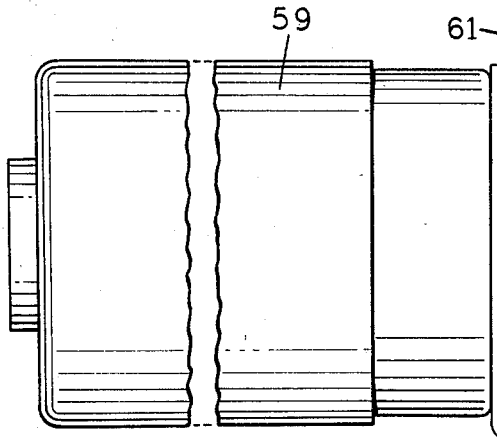
Figures 10, 10A:
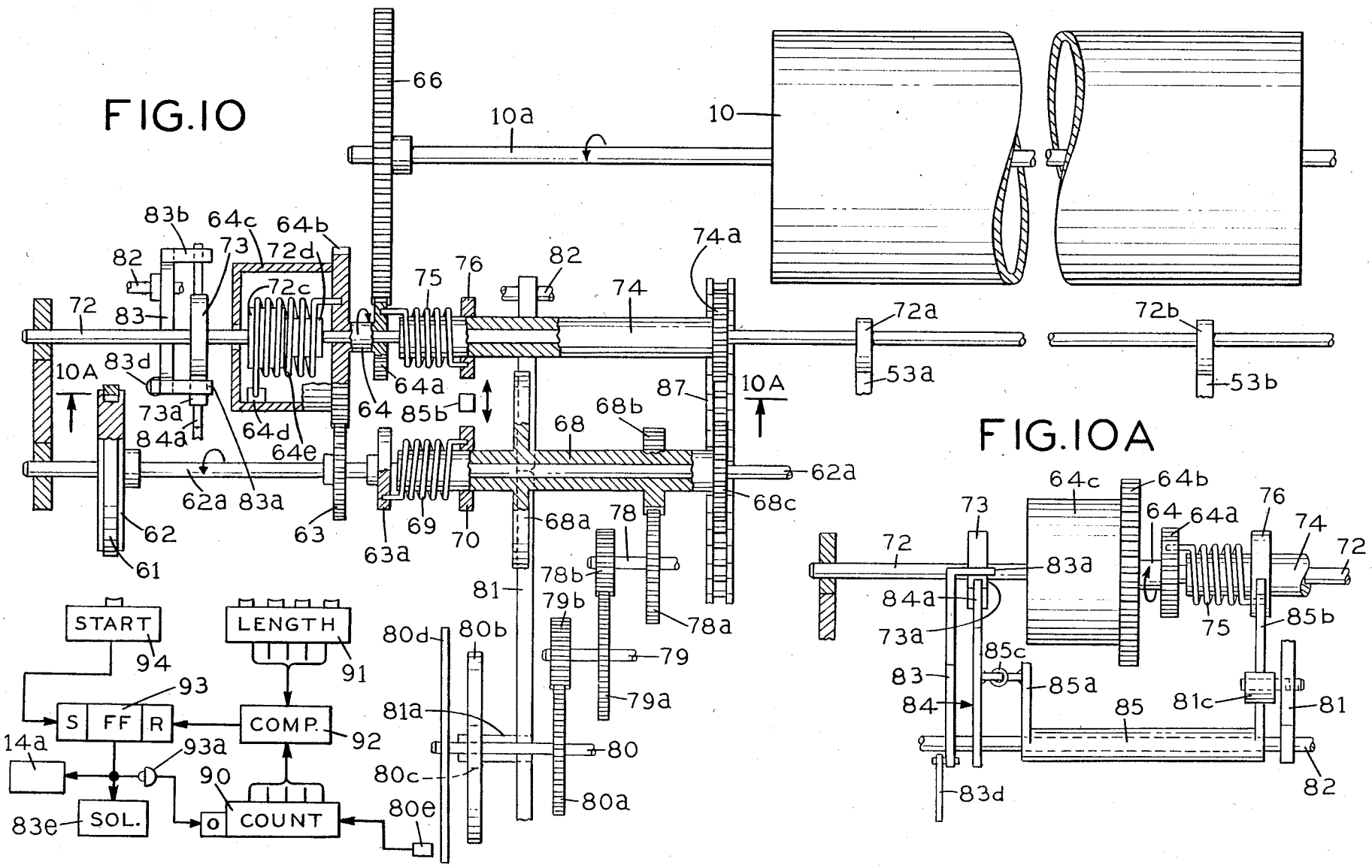
FIG. 10 is a partly schematic and generally top sectional view taken along the line 10—10 of FIGS. 6 and 6A.
FIG. 10A is a generally front sectional view taken along the line 10A—10A of FIG. 10.

As may best be seen from FIGS. 10A and 10B, member 84 is connected by springs 85c and 85d to a lever 85a secured to a sleeve 85 rotatably mounted upon shaft 82. Sleeve 85 also mounts the clutch control arm 85b. A stop lever 81 is rotatably mounted upon shaft 82 and is provided with an adjustable eccentric 81c which bears against clutch arm 85b. As best seen in FIG. 9, lever 81 is provided with a tooth 81b which cooperates with a corresponding detent 68d in cam 68a. The free end of lever 81 is biased upwardly by a spring 81d as shown in FIG. 6A.

Pinion 68b drives a gear 78a secured to a shaft 78 which also mounts a pinion 78b. Pinion 78b meshes with a gear 79a secured to a shaft 79 which also mounts a pinion 79b. Pinion 79b meshes with a gear 80a secured to a shaft 80 which mounts a cam 80b. Lever 81 is provided with a pin 81a which cooperates with a detent 80c formed in cam 80b, as best shown in FIG. 6A.

Chain 87, which engages both the forward drive sprocket 74a and the reverse drive sprocket 68c, also engages a sprocket 24b mounted on the shaft 24a of spool 24. Chain 87 further engages sprocket 31b mounted on shaft 31a of spool 31. Also secured to spool shaft 24a is a sprocket 24c, shown in FIG. 7, which engages a chain 87a. Chain 87a drives a sprocket 26b mounted on shaft 26a of spool 26. As may be seen by reference to FIG. 7B, a sprocket 26c is secured to spool shaft 26a upon the right hand side of the machine. Sprocket 26c engages a chain 87b which drives a sprocket 28b secured to the shaft 28a of spool 28.

The shield and pressure plate films 51 and 49 are both maintained under tension. Spool 24 is provided with a helical spring 24d (FIG. 7) which biases spool counterclockwise in FIG. 1 relative to shaft 24a to maintain film 51 under tension. Similarly spool 28 is provided with a helical spring 28c (FIG. 7B) which biases spool 28 clockwise in FIG. 1 relative to shaft 28a to maintain film 49 under tension.

Referring again to FIG. 6, gear 66 engages a gear 67 mounted upon a shaft which also mounts a sprocket 67a. Sprocket 67a engages a chain 67b which drives the shafts 34a and 37a of rollers 34 and 37 to move copy paper into the machine. Chain 67b also engages a sprocket 67c mounted on the shaft 41a of roller 41. Also secured to shaft 41a is a further sprocket (not shown) which engages a chain 67d. Chain 67d drives the shafts 18a and 44a of rollers 18 and 44 which pass copy paper through and out of the machine.

Figure 6:
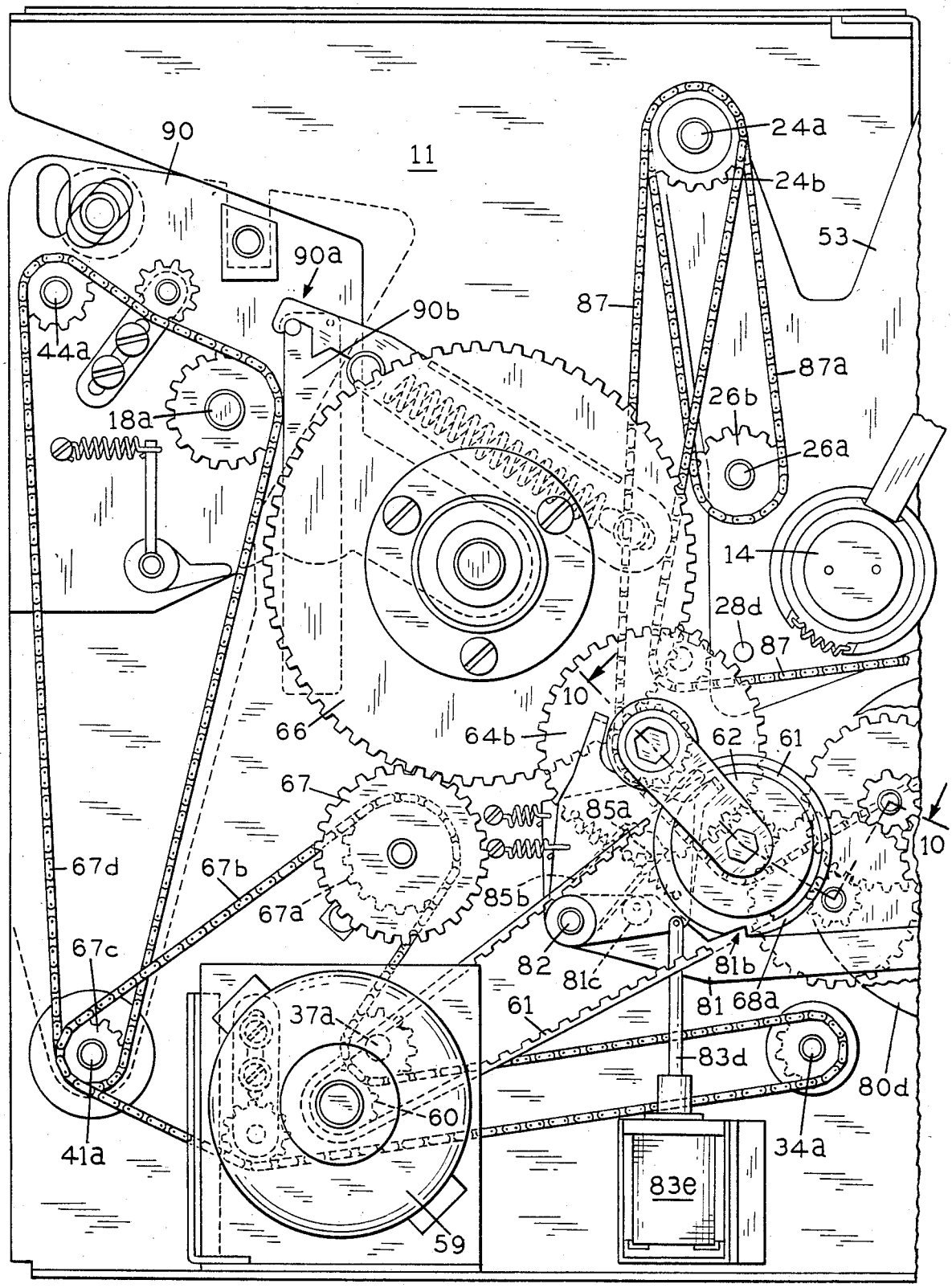
FIGS. 6 and 6A comprise a left side view.
Figures 6A, 9, 9A:
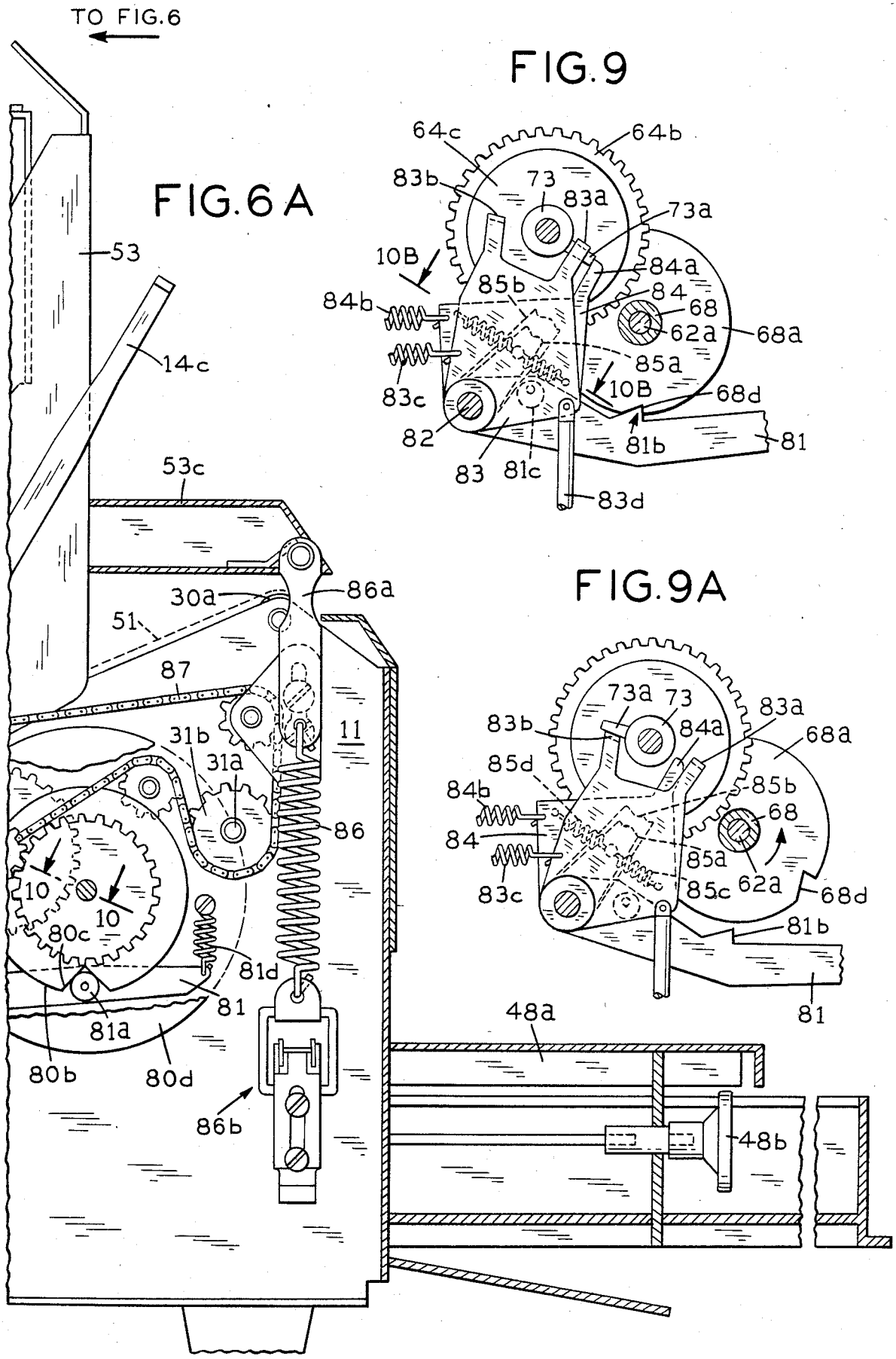
FIG. 9 is a fragmentary view showing the disposition of forward and reverse clutch control parts at the beginning and end of a cycle of operation.
FIG. 9A is a fragmentary view showing the disposition of clutch control parts shortly after the beginning of a cycle of operation.
Figure 8:
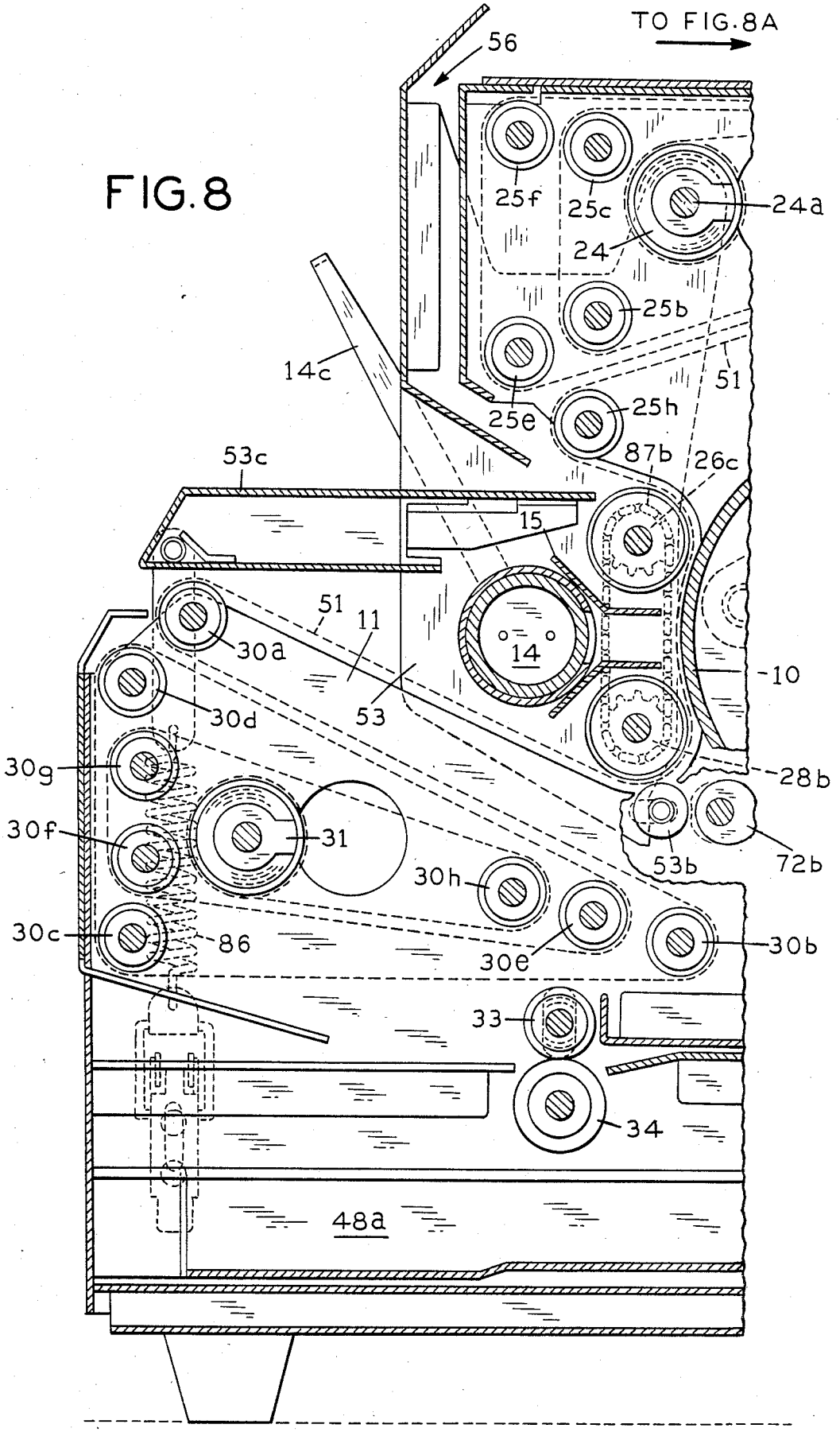
FIGS. 8 and 8A comprise a sectional right side view.
Figure 8A:
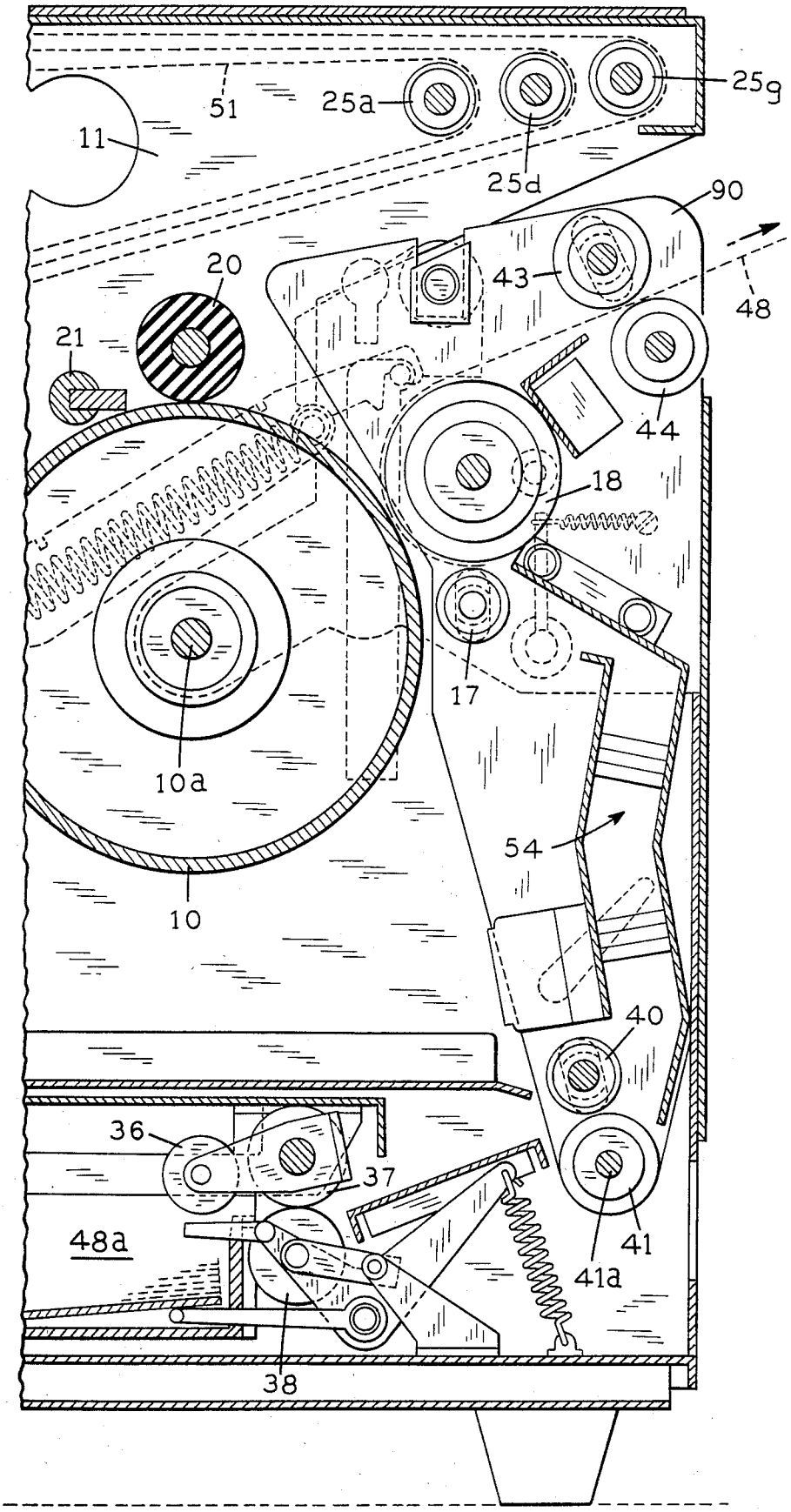

As shown in FIGS. 1, 6 and 8A, rollers 17, 18, 43 and 44 are mounted upon a member 90 which is pivotally supported on shaft 41a so that the rear portion of the machine which encompasses the path for copy paper may be opened for ready access. Similarly, the front of the machine may be readily opened to access by pivoting member 53 which is rotatably mounted on shaft 24a. Member 53 is resiliently biased counterclockwise in FIG. 1 and hence clockwise in FIG. 6A by a pair of springs 86 mounted on either side of the machine. One end of spring 86 is secured to a link 86a which engages a shelf 53c upon which the original 50 is laid for insertion into the machine. The other end of spring 86 is secured to a releasable latch 86b. To open the front of the machine for inspection of the shield and pressure plate membranes 51 and 49, it is merely necessary to release latches 86b and then pull member 53 outwardly and upwardly.

Referring again to FIG. 10, also secured to shaft 80 is an incremental encoding disk 80d which may conveniently be of the magnetic type having a plurality of closely spaced magnetized portions along its periphery. A magnetic sensor 80e is disposed in proximity to the periphery of encoder disk 80d to sense these magnetic elements or marks. The output of sensor 80d is coupled to a counter 90. The length of the original 50 to be copied is indicated by depressing one of a plurality of push buttons associated with a circuit 91, which provides a corresponding digital output. The outputs of circuit 91 and counter 90 are compared in a comparator 92; and the output thereof is applied to the resetting input of a flip-flop 93. A push button activated start switch 94 sets flip-flop 93. Flip-flop 93 energizes solenoid 83*e* and enables the exciting circuit 14*a* of lamp 14. The output of flip-flop 93 is further applied through an inverter to an input of counter 90 which resets its count to zero.

In operation, drive motor 59, through pinion sheave 60, belt 61 and toothed sheave 62, rotates shaft 62*a* continually in the direction of the arrow shown in FIG. 10. Gear 64*b*, sleeve 64 and gear 64*a* continually rotate in the opposite direction as shown by the arrow in FIG. 10. This in turn continually drives shaft 10*a* in the direction of the arrow shown in FIG. 10. Cam shaft 72 is normally stationary. As housing 64*c* rotates with gear 64*b*, that portion of spring 64*e* surrounding centering drum 72*d* will wind up thus producing a torque upon the shaft 72 through the clutching action of that portion of spring 64*e* which engages clutch drum 72*c*. As will be pointed out subsequently, cam shaft 72 rotates counterclockwise (FIGS. 8 and 9) in increments of one-half revolution. During motion of shaft 72, that portion of spring 64*e* surrounding centering drum 72*d* unwinds. It is desired that the torque produced by spring 64*e* upon shaft 72 at the end of a half-revolution increment of shaft 72 not be excessively reduced. Accordingly, spring 64*e* should be wound around centering drum 72*d* through at least one revolution. The torque on shaft 72 at the end of a half-revolution increment will thus be half the original torque. If that portion of spring 64*e* surrounding centering drum 72*d* is wound through two revolutions, then the torque on shaft 72 at the end of a half-revolution increment will be three-quarters of the original torque. As gear 64*b* and drum 64*c* rotate, tab 64*d* engages the free end of spring 64*e*, unwinding that portion of spring 64*e* which engages clutch drum 72*c*. This permits the clutch to slip while maintaining upon shaft 72 a torque corresponding to, for example, the winding of spring 64*e* through two revolutions about centering drum 72*d*.

In FIG. 10, cams 72*a* and 72*b* are shown in engagement with followers 53*a* and 53*b*, which rotates member 53 to the position shown in FIGS. 4 and 5 where film 51 is out of contact with drum 10. As shown in FIG. 9, lug 83*a* of escapement 83 engages tooth 73*a* which prevents rotation of cam shaft 72 despite the torque produced by that portion of spring 64*e* surrounding centering drum 72*d*. The operator inserts original 50. The operator also inserts copy paper 47 if its length is greater than that which may be accommodated by cassette 48*a*, which provides automatically fed copy paper 48. The operator then indicates the length of the original by depressing a corresponding push button of circuit 91. Finally the operator depresses start button 94, which sets flip-flop 93. This excites lamp 14 through circuit 14*a*, enables counter 90 to count from zero, and energizes solenoid 83*e*. Link 83*d* moves downwardly, thus rotating eccentric 83 from the position shown in FIG. 9 to that shown in FIG. 9A against the action of spring 83*c*. When lug 83*a* of escapement 83 releases tooth 73*a*, spring 64*e* unwinds thus rotating shaft 72 through approximately half a revolution where tooth 73*a* now engages a lug 83*b* of escapement 83. Cams 72*a* and 72*b* are thus rotated to the position shown in FIG. 8 which permits springs 86 to rotate member 53 counterclockwise (as in FIG. 2) until film 51 bears against drum 10.

When tooth 73*a* rotates from the position shown in FIG. 9 to that shown in FIG. 9A, it disengages lug 84*a* of clutch control member 84. Spring 84*b* thus moves member 84 counterclockwise. This motion of member 84 is transmitted through springs 85*c* and 85*d* to lever 85*a* and thence to clutch arm 85*b*, which engages the forward clutch control sleeve 76. Spring 75 winds itself about sleeve 74; and forward drive sprocket 74*a* now rotates synchronously with gear 64*a*, causing chain 87 to move. This rotates sprockets 31*b* and 24*b*, which drive respective spools 31 and 24 to move film 51. Sprocket 24*c* (FIG. 7) rotates synchronously with sprocket 24*b* and drives chain 87*a* which rotates sprocket 26*b* and spool 26. Sprocket 26*c* rotates synchronously with spool 26 and drives chain 87*b* (FIG. 7B) which rotates sprocket 28*b* and spool 28. Thus film 49 is also moved.

Motion of chain 87 also causes rotation of the reverse sprocket 68*c* which rotates sleeve 68. Movement of sleeve 68 causes cam 68*a* to rotate from the position shown in FIG. 9 to that shown in FIG. 9A. Tooth 81*b* of lever 81 rides out of the detent 68*d* in cam 68*a*, thus forcing lever 81 clockwise in FIGS. 9 and 9A until tooth 81*b* rides on the generally circular peripheral portion of cam 68*a*. Pin 81*a* (FIG. 6A) is moved partially out of detent 80*c* in cam 80*b*. As will be pointed out subsequently, cam 68*a* accurately defines the return or "home" position of the parts. Rotation of sleeve 68 and pinion 68*b* also rotates cam 80*b* through the gear reduction chain including gear 78*a*, pinion 78*b*, gear 79*a*, pinion 79*b* and gear 80*a*. Cam 80*b* determines only approximately the return or home position of the parts. As cam 80*b* rotates slowly (compared with cam 68*a*) from the position shown in FIG. 6A, pin 81*a* is forced further out of detent 80*c* until it rides on the generally circular peripheral surface of cam 80*b*. In the position of parts shown in FIG. 9A, cam 80*b* in conjunction with pin 81*a* rotates lever 81 sufficiently clockwise that tooth 81*b* no longer engages the surface of cam 68*a*.

As cam 80*b* and encoder disk 80*d* rotate from the home position, sensor 80*e* provides output pulses, the number of which is proportional to the amount of rotation of encoding disk 80*d*. When the output of counter 90 becomes equal to the preselected count representing the length of the original 50 as provided by circuit 91, comparator 92 provides an output which resets flip-flop 93. Exciting circuit 14*a* is disabled; and lamp 14 is extinguished. Solenoid 83*e* is no longer energized; and inverting circuit 93*a* causes the output of counter 90 to revert to zero.

The position of parts is now as shown in FIG. 3. When solenoid 83*e* is de-energized, spring 83*c* rotates escapement 83 counterclockwise in FIG. 9A to the position shown in both FIGS. 9 and 9B. Lug 83*b* disengages tooth 73*a*; and camshaft 72 rotates counterclockwise until tooth 73*a* engages lug 83*a*. Cams 72*a* and 72*b* rotate from the position shown in FIG. 8 to that shown in FIG. 10, where they bear against followers 53*a* and 53*b*. Member 53 rotates clockwise, as shown in FIG. 4 against the action of springs 86. Shield film 51 disengages the surface of drum 10 so that films 51 and 49 may be returned to the home position.

Figure 9B:
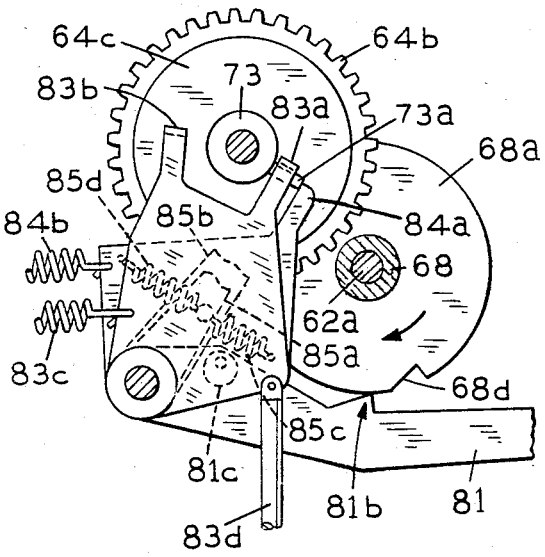
FIG. 9B is a fragmentary view showing the disposition of clutch control parts shortly before completion of a cycle of operation.

As tooth 73*a* moves from the position shown in FIG. 9A to that shown in FIG. 9B, it engages lug 84*a* which returns the clutch control member 84 to the position shown in both FIGS. 9 and 9B against the action of spring 84*b*. The clockwise rotation of member 84 is transmitted through springs 85*c* and 85*d* to arm 85*a* and then thence through sleeve 85 to arm 85*b*. Arm 85*b* disengages the forward drive clutch sleeve 76 and engages the reverse drive clutch sleeve 70. Because of the gear reduction provided between pinion 63 and gear 64*b*, reverse drive may be at a speed of approximately four times that of forward drive. When clutch arm 85*b* disengages sleeve 76, spring 75 unwinds itself from sleeve 74 thus disengaging the forward clutch. When arm 85*b* engages sleeve 70, spring 69 winds itself about sleeve 68 thus engaging the reverse clutch which couples sleeve 68 and sprocket 68*c* to member 63*a* and shaft 62*a*. Sprocket 68*c* moves chain 87 upwardly in FIG. 10. Again chain 87 directly drives spools 24 and 31 and, through chain 87*a* drives spool 26. Spool 26, through chain 87*b*, drives spool 28. During the reverse drive to home position, cam 80*b* maintains lever 81 in the position shown in FIG. 9A, where tooth 81*b* is well out of contact with periphery of cam 68*a*. When cam 80*b* has returned substantially to the home position, pin 81*a* drops into detent 80*c* under the action of spring 81*d*; and tooth 81*b* now rides on the generally circular periphery of cam 68*a*. The eccentric cam 81*c* is out of engagement, however, with clutch arm 85*b* which still bears against reverse clutch sleeve 70 as shown in FIG. 9B. As cam 68*a* rotates further clockwise in returning to the home position shown in FIG. 9, tooth 81*b* drops into detent 68*d*. Lever 81 rotates counterclockwise causing the adjustable eccentric cam 81*c* to bear against clutch arm 85*b* and move it midway between the forward and reverse clutch sleeves 76 and 70. When arm 85*b* disengages clutch sleeve 70, spring 69 unwinds; and the reverse drive clutch is disengaged. The sawtooth abutment of detent 68*d* engages the sawtooth 81*b* of lever 81, thus bringing the parts to rest at the home position.

To make a further copy of the same original 50, a second sheet of copy paper 47 is inserted until captured by rollers 33 and 34; and after short interval for advancing the leading edge of the copy paper to rollers 40 and 41, a ready light (not shown) will indicate to the operator that start button 94 may again be depressed.

Access to the copy paper handling path and the drum itself is obtained, as shown in FIGS. 1 and 6, by rotating latching handles 90*b* clockwise in FIG. 6 to release spring loaded latches 90*a* mounted on either side of the machine. Member 90 is then moved outwardly and downwardly, as shown in FIG. 1.

Figure 7:
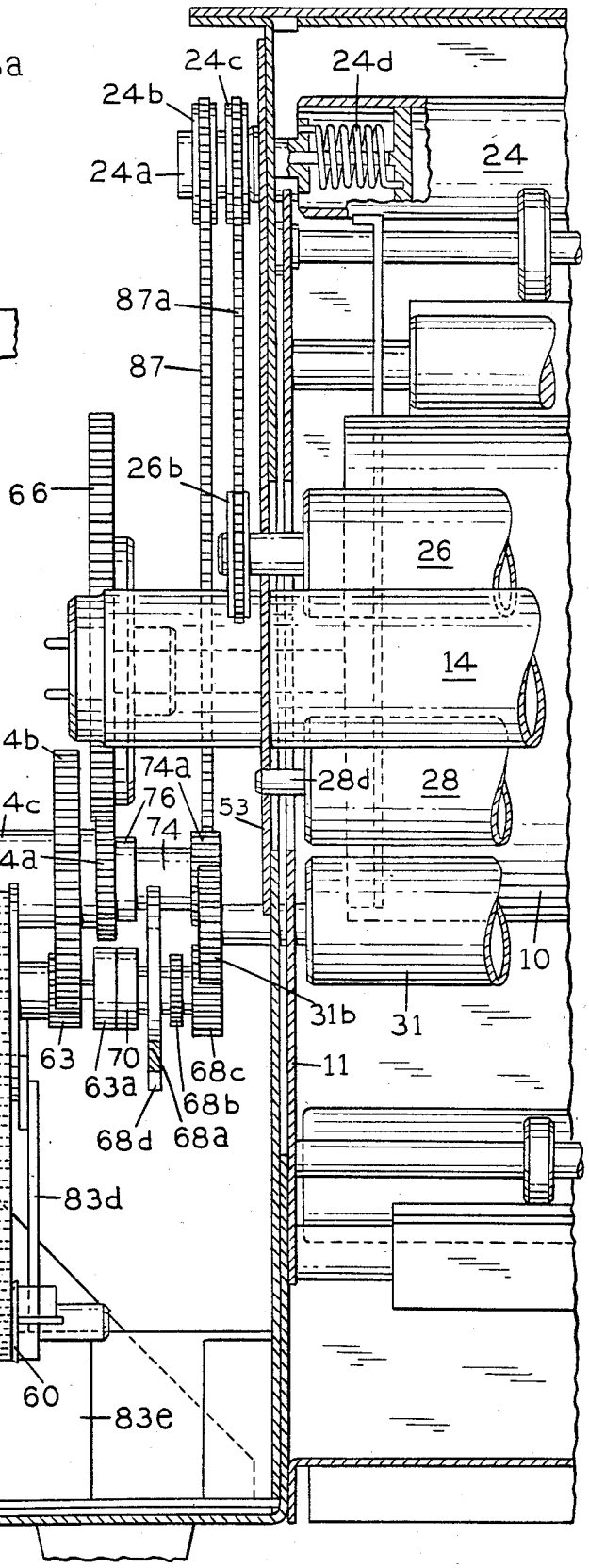
Figure 7B:
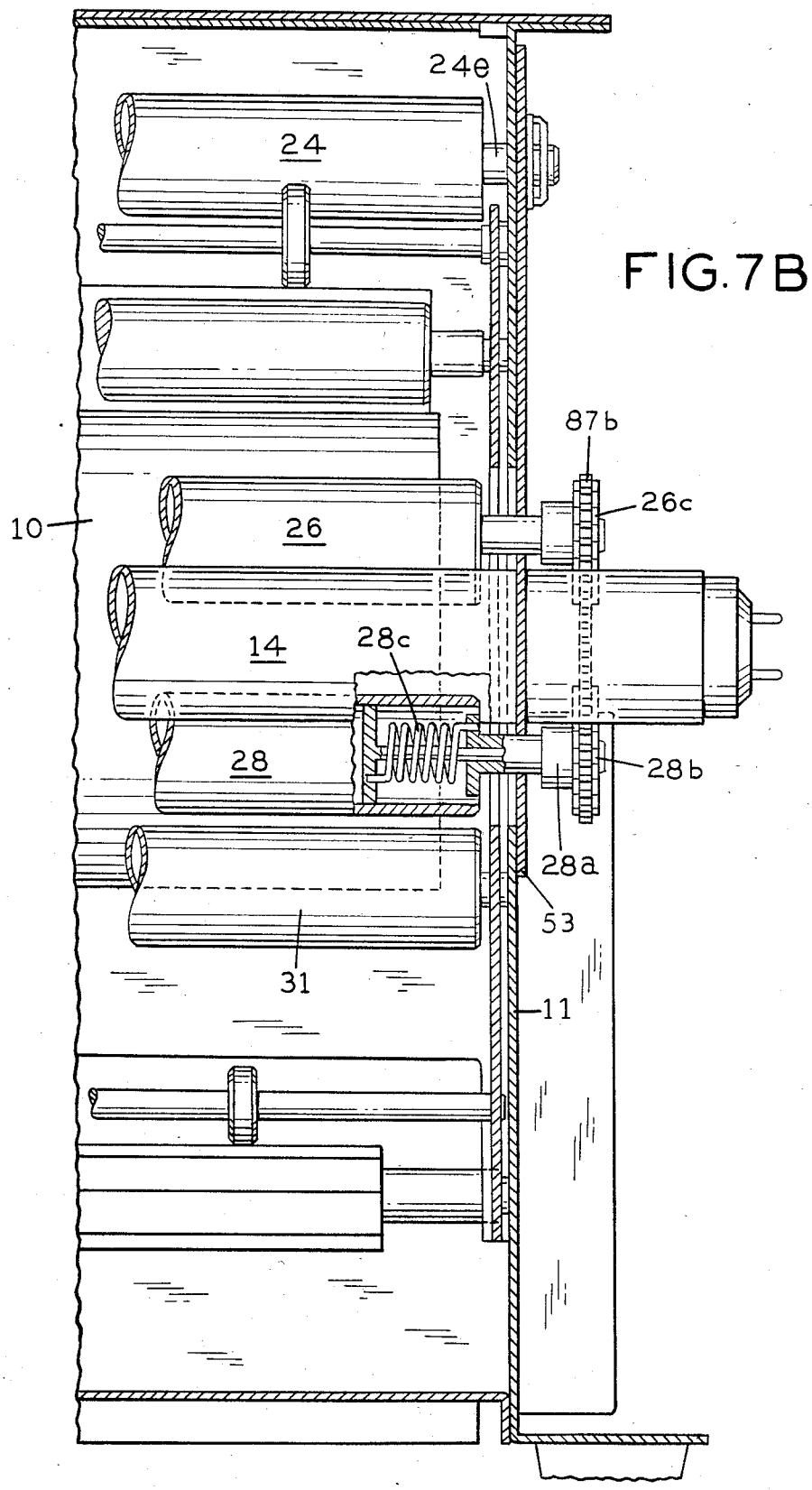

Members 53 are mounted outside the sidewalls 11 of the machine, as shown in FIGS. 7 and 7B, so that members 53, which carry spools 26 and 28 and lamp 14, may be rotated about shaft 24*a*. Members 53 also mount the outer wall of channel 56, the inner wall of channel 56 being fixed to the front of the machine. When members 53 are rotated through more than 60°, for example, to obtain access, film 51 under tension from spring 24*d* will pass directly from roller 25*h* to roller 30*a* along a line which just clears the inner or fixed wall of channel 56.

Cassette 48*a* supplies automatically fed copy paper 48 for the shorter lengths and slides out of and into the lower front of the machine where it is latched by a release knob 48*b* as shown in FIG. 6A.

It will be seen that I have accomplished the objects of my invention. I have provided an electrophotocopier for relatively large and valuable originals such as engineering drawings, wherein contact exposure obviates the extremely high lamp power and large lenses required in optical projection. The relatively low lamp power for contact exposure is readily accommodated by a fluorescent lamp. Adjustment of exposure is obtained by employing an aperture lamp. Contamination of the original document by solid or liquid components of the developer remaining upon the photoconductor drum is completely inhibited by providing a thin flexible transparent shield film between the photoconductive drum and the original. Contamination of both sides of the shield film itself is prevented by providing an extended and generally spiral path, wherein the film is supported without contact between its two surfaces.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is therefore to be understood that my invention is not to be limited to the specific details shown and described.

Having thus described my invention, what I claim is:

1. A machine for making an electrophotocopy of an original having a certain length including in combination a drum having a photoconductive surface, a membrane having two surfaces, one membrane surface being disposed in contact with the photoconductive surface, the original being disposed in contact with the other membrane surface, and means for directing light through the original and the membrane to the photoconductive surface, the circumference of the drum surface being less than said length.

2. A machine for making an electrophotocopy of an original including in combination a photoconductive surface, a first membrane having two surfaces, one membrane surface being disposed in contact with the photoconductive surface, the original being disposed in contact with the other membrane surface, a second membrane, the second membrane being disposed in contact with the original, means for directing light through the second membrane and the original and the first membrane to the photoconductive surface, and means for moving the surface and the two membranes and the original at the same linear velocity.

3. A machine for making an electrophotocopy of an original including in combination a drum having an axis and an exterior photoconductive surface, means for charging said surface, and means for creating on said surface an electrostatic image by contact exposure of the original, said contact exposure means including a fluorescent lamp positioned to direct light toward the drum axis.

4. A machine for making an electrophotocopy of an original including in combination a photoconductive surface, means for charging said surface, and means for creating on said surface an electrostatic image by contact exposure of the original, said contact exposure means including a fluorescent aperture lamp, a fixed aperture comparable in size to that of the lamp, and means for rotating the lamp to control the extent of exposure of said surface.

5. A machine for making an electrophotocopy of an original including in combination a drum having a photoconductive surface, a pair of spools, a membrane wound about said spools and having a portion on one side thereof which contacts said surface, said original being disposed in contact with said portion of the membrane on the other side thereof, and means for moving said surface and the membrane and the original at the same linear velocity.

6. An electrophotocopier including in combination a drum having a photoconductive surface, a first and a second spool, a membrane having a first and a second surface, said membrane being wound about said spools, a first and a second and a third roller, the membrane passing from the first spool successively around the first and over the second and third rollers to the second spool, the second and third rollers each contacting the second surface of the membrane and holding that portion of the first surface therebetween in contact with the photoconductive surface, and the first roller contacting the first surface of the membrane over an appreciable central angle thereof.

7. An electrophotocopier including in combination a drum having a photoconductive surface, a first and a second spool, a membrane having a first and a second surface, the membrane being wound about said spools, a portion of the first surface of the membrane contacting said photoconductive surface, a first plurality of rollers, a second plurality of rollers, a further roller, the membrane passing from the first spool over each roller of the first plurality and successively around the further roller to said contacting portion and passing from said contacting portion over each roller of the second plurality to the second spool, each roller of the first and second pluralities contacting the second surface of the membrane, and the further roller contacting the first surface of the membrane over an appreciable central angle thereof.

8. An electrophotocopier including in combination a drum having a photoconductive surface, a first and a second spool, a membrane wound about said spools, a first plurality of rollers, a second plurality of rollers, the membrane passing from the first spool over each roller of the first plurality in a path describing generally an expanding spiral, the membrane passing over each roller of the second plurality to the second spool in a path describing generally a contracting spiral, the membrane extending from the first plurality of rollers to the second plurality of rollers and including a portion contacting the photoconductive surface, the rollers of the first and second pluralities being so disposed as to provide said respective spiral paths.

9. An electrophotocopier including in combination a drum having a photoconductive surface, a pair of spools, a membrane wound about said spools, means for moving the photoconductive surface with a certain linear velocity, means selectively operable to bring a portion of the membrane into contact with the photoconductive surface and to move the membrane in the same direction and with the same velocity as the photoconductive surface, and means selectively operable to bring the membrane out of contact with the photoconductive surface and to move the membrane in a direction opposite to that of the photoconductive surface.

10. An electrophotocopier including in combination, a drum having a photoconductive surface, a first membrane, a second membrane, means including a pair of rollers for supporting both membranes, and means for selectively moving the pair of rollers toward and away from the photoconductive surface.

11. An electrophotocopier including in combination a drum having a photoconductive surface, a pair of spools, a membrane wound about said spools, and means for selectively moving the spools toward and away from the photoconductive surface.

12. An electrophotocopier including in combination a drum having a photoconductive surface, a pair of spools, a membrane wound about said spools, means for selectively moving the spools toward and away from the photoconductive surface, and means for maintaining the membrane under a uniform tension between the spools.

* * * * *